US005256088A

United States Patent [19]

Lu et al.

[11] Patent Number: 5,256,088

[45] Date of Patent: Oct. 26, 1993

[54] CONTACT FOR IC MEMORY CARD

[75] Inventors: Sidney Lu, Taipei; Gwou-Jong Tseng, Taipei Hsien, both of Taiwan

[73] Assignee: Foxconn International, Inc., Sunnyvale, Calif.

[21] Appl. No.: 982,845

[22] Filed: Nov. 30, 1992

[51] Int. Cl.[5] ..... H01R 11/22

[52] U.S. Cl. ..... 439/851; 439/856

[58] Field of Search ..... 439/851-857, 439/861, 862, 842, 843

[56] References Cited

U.S. PATENT DOCUMENTS

| | | | |
|---|---|---|---|
| 3,663,931 | 5/1972 | Brown | 339/218 R |
| 4,655,522 | 4/1987 | Beck | 339/32 M |
| 4,666,227 | 5/1987 | Galizia et al. | 439/851 |
| 4,687,278 | 8/1987 | Grabbe | 439/842 |
| 4,720,277 | 1/1988 | Sakamoto | 439/842 |
| 4,721,484 | 1/1988 | Sakamoto | 439/842 |
| 4,722,704 | 2/1988 | VanDerStuyf et al. | 439/851 |
| 4,767,350 | 8/1988 | Cooper et al. | 439/851 |
| 4,874,338 | 10/1989 | Bakermans | 439/851 |
| 4,886,474 | 12/1989 | Drogo | 439/856 |
| 4,909,746 | 3/1990 | Scholz | 439/82 |

*Primary Examiner*—David L. Pirlot

[57] ABSTRACT

A female contact (40) is formed by a plate and has a contact section (46) in the front, a retention section (44) in the midst and a biased tail (45) in the rear. The contact section (46) includes a front ring (41) and a rear ring (42) positioned at two opposite ends thereof, and three beams (431, 432, 433) spaced apart from and parallel to each other, and integrally connected between the front ring (41) and the rear ring (42), respectively. These three beams (431, 432, 433), including a base beam (432) and a pair of auxiliary beams (431, 433) positioned above the base beam (432) within an appropriate angle range relative to the vertical line (L1) of the base beam (432), are inward bowed to each other proximate the middle portion wherein each beam (431, 432, 433) has itself an identical width along its length while the width of the base beam (432) is relatively larger than that of the auxiliary beams (431, 433).

8 Claims, 5 Drawing Sheets

CONTACT FOR IC MEMORY CARD

BACKGROUND OF THE INVENTION

1. Field of The Invention

The invention relates to contacts for use with an IC memory card, particularly to a contact having a smooth and symmetrical configuration which disperses applied stress evenly thus reducing the phenomenon of stress concentration and balancing a male contact therein.

2. The Prior Art

IC memory cards are gradually and popularly used in the market due to their compact size and tremendous memory capacity. As shown in FIGS. 1 and 2, such memory card includes a board 11 with a soldered IC chip 11*a* thereon and enclosed within a protection shield 10 wherein a set of connection section is positioned on the front portion for connection with a connector 20 which is mounted on and electrically communicates with a main board 21 for operation with the inserted memory card. It can be understood that the connection between the female contact 31 of the memory card 10 and the male contact 80 of the complementary connector 20 is an important factor affecting the precision of the signal transmission between the memory card 10 and the main board 21. Moreover, it is appreciated that the configuration of a socket-type female contact 31 is the key point for determining if such female contact has a good mechanical and electrical connection with a generally pin-type male contact 80 of the connector 20 inserted therein.

One type prior art socket-type female contact 31 of the memory card, as shown in FIGS. 3 and 4, comprises a pair of parallel beams 32 respectively joined on tow U-shaped sections 33 by their two opposite ends 34 for retaining a pin-type male contact 80 therebetween. Referring to FIG. 4, the male contact 80 may swing therein in the lateral direction thus affecting the stability of the signal transmission. Additionally, each beam 32 has a narrowed root, i.e., end 34, connected to the corresponding U-shaped section 33 and a wider connection portion in the midst. The expanded contact portion in the midst where the cross-sectional view FIG. 4 is taken from, is good for the connection between the pin-type male contact 80 and the female contact 31 thereabout, but otherwise a relatively larger stress will occur around the end 34 portion, thus affecting the performance of the whole configuration of the female contact 31.

Shown in FIGS. 5,6(A) and 6(B) is another type prior art female contact 31' which has a pair of opposite beams 320, 322 jointly connected to each other through a pair of square type sections positioned at two opposite ends 33' thereof, respectively, wherein the upper beam 320 is composed of a left half 321 and a right half 322 which are juxtaposed with each other. Referring to FIGS. 6(A) and 6(B), although the left half 321 and the right half 322 are intentionally side by side positioned together without any space therebetween to form as an integrity corresponding to the lower beam 322 for a symmetrical and even whole configuration in order to obtain a better retention with the male contact 80, unfortunately, in an actual manufacturing process, it raises forming difficulties and complicates the plating procedure of the female contact 31' without an space $\alpha$ between the opposite edges of the left half 321 and the right half 323. Accordingly, without much endeavor in manufacturing control, a defect of the female contact occurs thereof which forms a pair of separate sharp edges A' and A" beside the space $\alpha$ as shown in FIG. 6(B) which may scratch the inserted male contact 80, instead of a purposive type as shown in FIG. 6(A) where an joined edge A is met by these two opposite beams 321 and 323.

In according with this invention, a new design of the contact has advantages over the aforementioned prior art design. The female contact of the present invention can achieve a stable retention with a male contact without any stress concentration or unbalanced force dispersion which incurs self-bending moment of the pin-type male contact. The present invention can also be operated without any potential scratch damage of the male contact inserted therein.

SUMMARY OF THE INVENTION

In accordance with one aspect thereof, the invention is directed to a contact for use with an IC memory card. The contact is formed by a plate and has a contact section in the front, a retention section in the middle and a biased tail in the rear. The contact section includes a front ring and a rear ring positioned at two opposite ends thereof, and three beams spaced apart from and parallel to each other and integrally connected between the front ring and the rear ring, respectively. These three beams including a base beam and a pair of auxiliary beams symmetrically positioned above the base beam within an appropriate angle range relative to the vertical line extending from the base beam, are bowed inward to each other proximate the middle portion wherein each beam has itself an identical width along its length while the width of the base beam is relatively larger than that of the auxiliary beams. Accordingly, the male contact is compactly and securely positioned within the inner space formed by these three beams and electrically and mechanically connected to the three contact regions on the beams, respectively. Moreover, the contact region of each contact has a straight and smooth line contour to face the corresponding male contact.

BRIEF DESCRIPTION OF THE DRAWINGS

FIG. 6(A) is a cross-sectional view of the female contact of

DETAILED DESCRIPTION OF THE INVENTION

Figure 7:
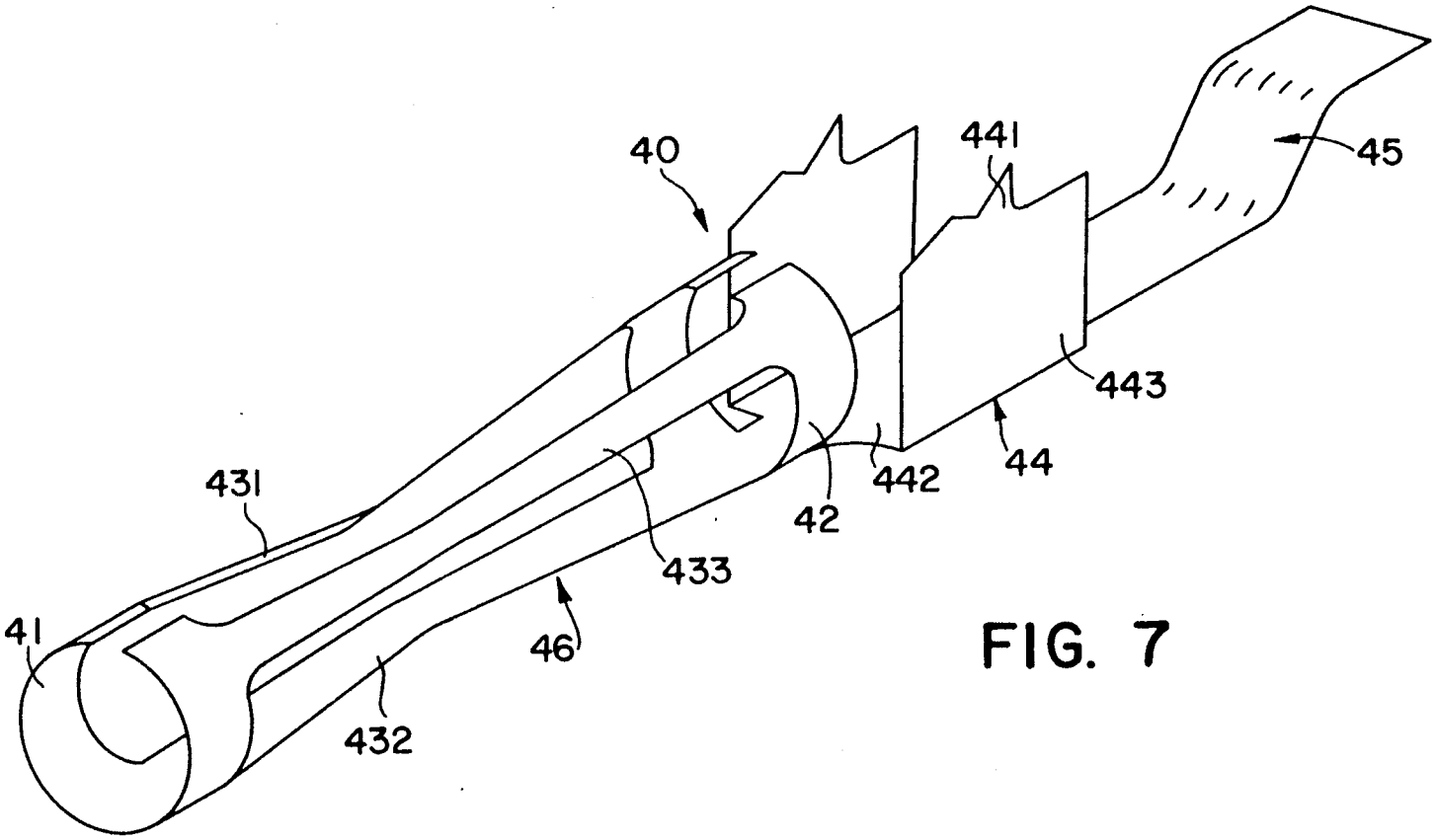
FIG. 7 is a perspective view of a female contact for use with an IC memory card of an embodiment of the present invention.
Figure 8:
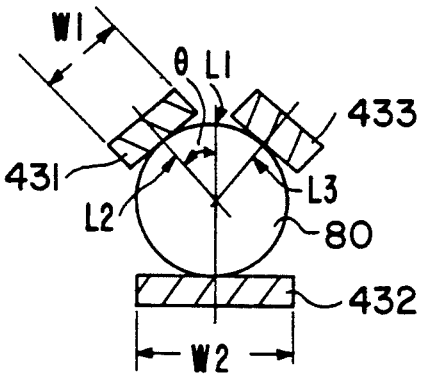
FIG. 8 is a cross-sectional view of the female contact of FIG. 7 incorporating an inserted typical pin-type male contact cut along a plane proximate to the contact region of each beam.

With reference to FIG. 7, the female contact 40 includes a contact section 46 in the front, a retention section 44 in the middle and a biased tail 45 in the rear. The contact section comprises a front C-shaped ring 41 and a similar shape rear ring 42, and three spaced parallel beams 431, 432, 433 integrally connected therebetween. These three beams 431, 432, 433 composed of the base beam 432 and a pair of auxiliary beams 431 and 433, are inward bowed to each other proximate in the midst to form contact regions evenly surrounding and contacting an male contact 80 thereamong, as shown in FIG. 8. Each beam has itself an identical cross dimension along its length for avoiding effecting any stress concentration due to variation of the width, while the base beam 432 is wider than the other two auxiliary beams 431 and 433 for achieving a better balanced force absorption around the contact which will be illustrated in detail later.

Figure 9:
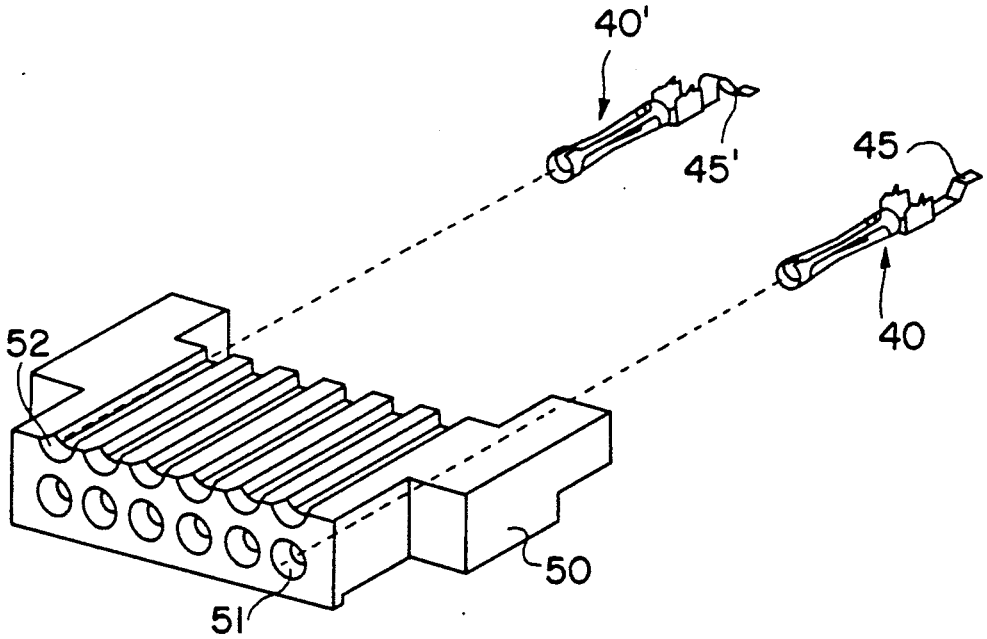
FIG. 9 is a perspective view of a partial IC memory card to show the upper row contact and the lower row contact positioned therein.

The retention section 44 of the contact 40 is of a U-shaped form wherein the bight portion 442 is aligned with the tail 45 and the base beam 432, and each vertical leg 443 has a barb 441 on the top for retention within the IC memory card housing 50, also referring to FIG. 9. The biased tail 54 is formed for consideration of corresponding to the difference of the upper and the lower row holes in which the contact 40 is disposed.

Referring to FIG. 8, it can been seen that the male contact 80 is properly and compactly held by the contact regions of the corresponding three beams 431, 432 and 433 of the female contact 40 whereby a stable and reliable mechanical and electrical connection can be obtained therebetween.

Referring to FIG. 9, the memory card housing 50 has a plurality of lower row holes 51 and a plurality of upper row holes 52 to respectively therein receive the corresponding lower row female contact 40 and upper row female contact 40' wherein the tail 45' of the upper row contact 40' and the tail 45 of the lower contact 40 project to each other for moving close to the corresponding chip circuit (not shown) positioned therebetween.

Figure 1:
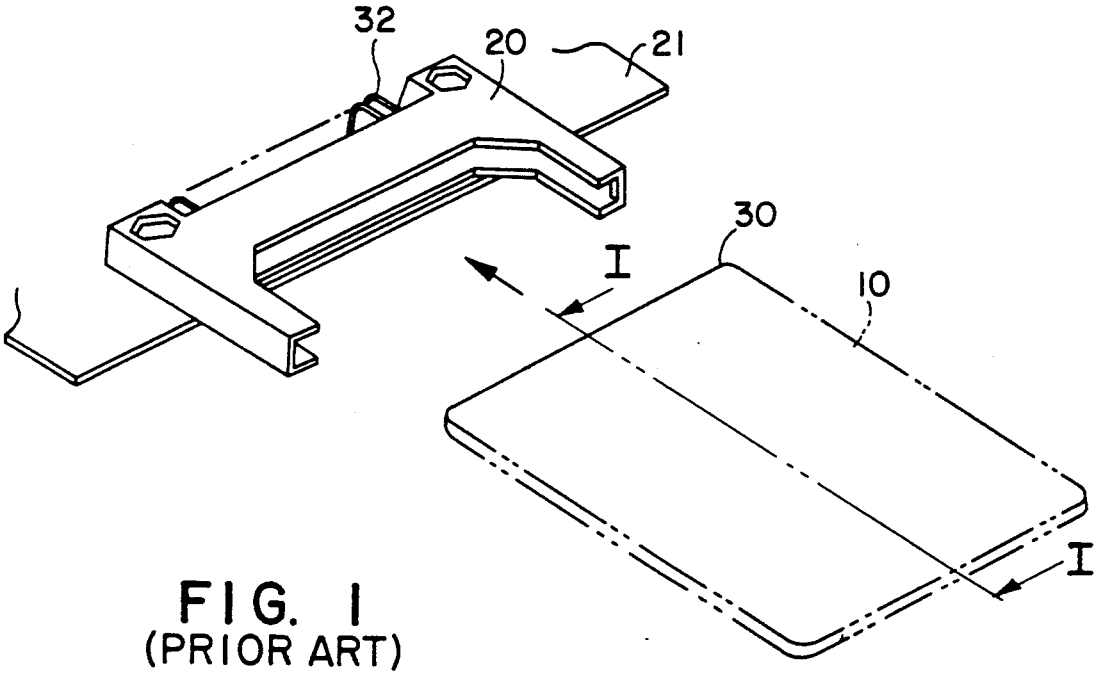
FIG. 1 (PRIOR ART)
FIG. 1 is a perspective view of an IC memory card incorporating a corresponding connector mounted on a board.
Figure 2:
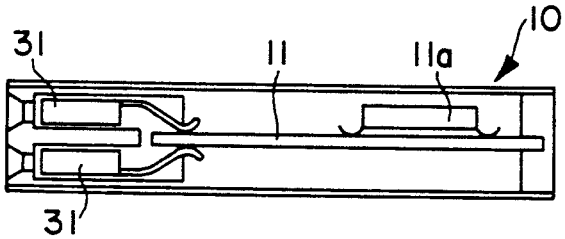
FIG. 2 (PRIOR ART)
FIG. 2 is a cross-sectional view of the memory card of FIG. 1 taken along the line I—I.
Figure 3:
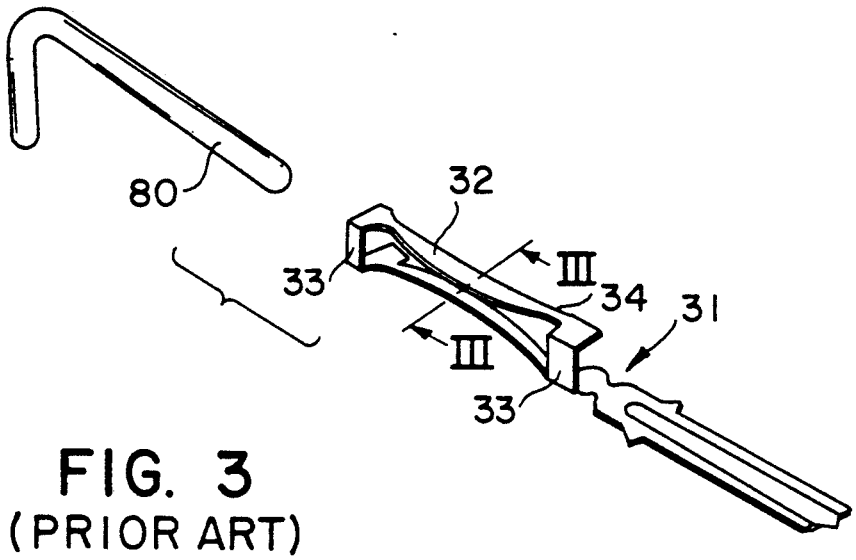
FIG. 3 (PRIOR ART)
FIG. 3 is a perspective view of a prior art female contact for use with an IC memory card and a complementary typical pin-type male contact.
Figure 4:
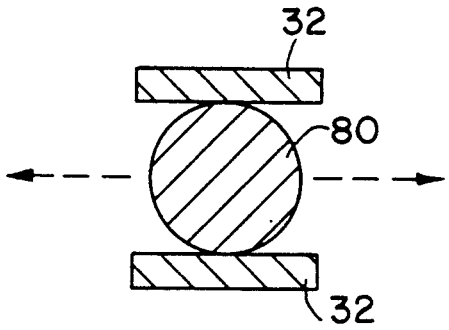
FIG. 4 (PRIOR ART)
FIG. 4 is a cross-sectional view of the female contact and the male contact of FIG. 3 along the line III—III.
Figure 5:
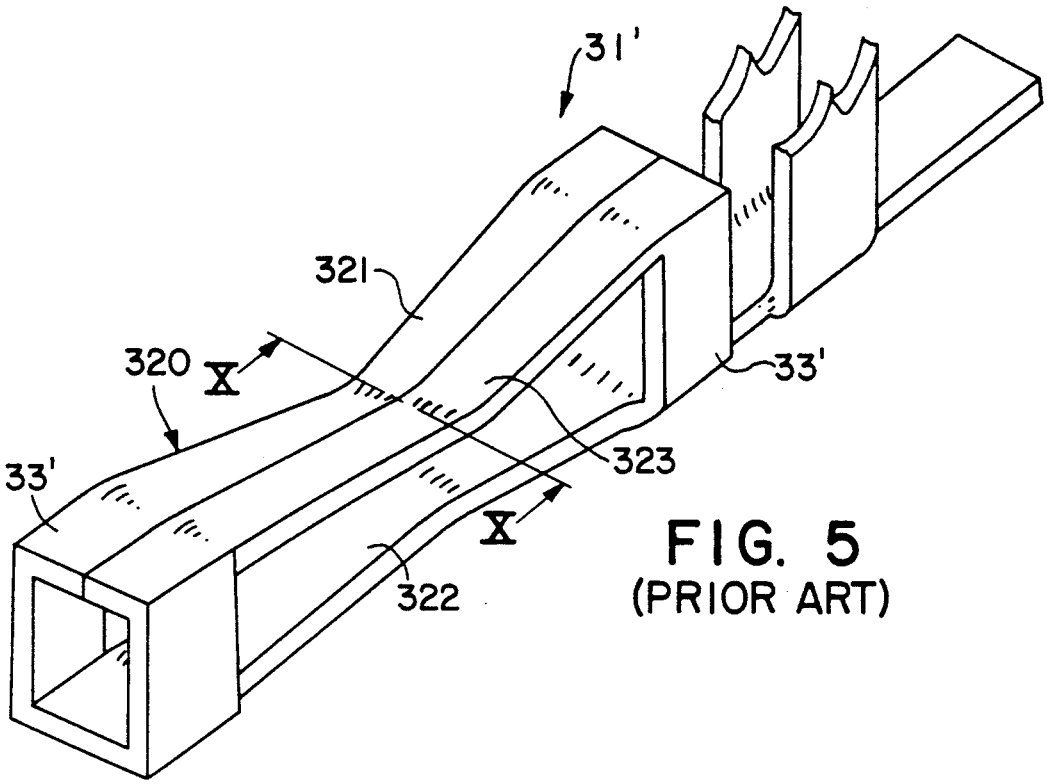
FIG. 5 (PRIOR ART)
FIG. 5 is a perspective view of another prior art female contact for use with an IC memory card.
Figure 6A:
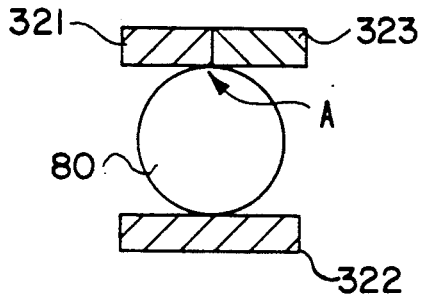
FIG. 6(A) (PRIOR ART)
Figure 6B:
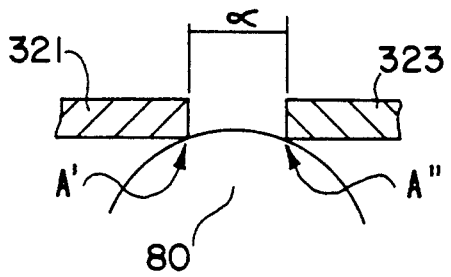
FIG. 6(B) (PRIOR ART)
FIG. 6(B) is a cross-sectional view of the female contact of FIG. 5 along the line X—X in a common situation.

In the present invention, referring to FIG. 8, the relationship between the width W1 of the auxiliary beam 431 or 433 and the width W2 of the base beam 432 can be defined by a formula: $2W1 \cos \Theta = W2$ wherein $7.5 < \Theta < 90$ degrees and is defined by a vertical line L1 which is perpendicular to the contact region of the base beam 432 and the line L2 or L3 which are perpendicular to the contact region of the auxiliary beam 431 or 432. It can be understood that in the present embodiment, these three liens may designedly be positioned in a same plane and intersect with each other proximate the center point of the male contact 80, thus generally obtaining a zero value compound force acting on the male contact 80 and not resulting in any improper obliquity or self-moment of the male contact 80. Additionally, as experienced and simulated, to obtain a better stress dispersion corresponding to the length of the male contact 80, the contact regions of the beams 431, 432, 433 are positioned near $1/\sqrt{2}$ of the entire length of each beam form the rear ring 42. It is seen that the contact region of each beam 431, 432, 433 is in a form of straight line where no protrusion can occur to jeopardize the inserted pin-type male contact 80. Moreover, the C-shaped front and rear rings provide a better elasticity thereof than an intentionally sealed section of the prior art female contact as shown in FIG. 5.

While the invention has been described in connection with what is presently considered to be the most practical and preferred embodiment, it is to be understood that the invention is not limited to the disclosed embodiment by, on the contrary, is intended to cover various modifications and equivalent arrangement included within the spirit and the scope of the appended claims.

Therefore, persons of ordinary skill in this field are to understand that all such equivalent structures are to be included within the scope of the following claims:

What is claimed is:

1. A female contact for use with an IC memory card comprising: a contact section in the front, a retention section in a medial region, and a biased tail in the rear wherein the contact section includes a front ring, a rear ring, and three parallel and spaced beams respectively connected therebetween, said three beams comprising a base beam and two auxiliary beams positioned above the base beam, each beam itself having an identical width along its entire length and following a formula: $2W1 \cos \Theta = W2$ wherein W1 is a width of the auxiliary beams, W2 is a width of the base beam, and $\Theta$ is defined between a first line perpendicular to the base beam and a second line perpendicular to the auxiliary beam.

2. The female contact as described in claim 1, wherein each beam has a contact region, in a form of straight line, positioned proximate $1\sqrt{2}$ of an entire length of the beam.

3. The female contact as described in claim 1, wherein the front ring and the rear ring are C-shaped.

4. The female contact as described in claim 1, wherein $\Theta$ is within the range between 7.5 and 90 degrees.

5. The female contact as described in claim 1, wherein the retention section is of a U-shaped form including a bight portion and two vertical legs on which two barbs are positioned, respectively.

6. The female contact as described in claim 5, wherein the bight portion is aligned with the tail and the base beam.

7. A female contact for use with an IC memory card comprising a contact section, a retention section and a tail, said contact section including at least three parallel and spaced beams connected between a first end and a second end wherein the second end is positioned proximate the retention section, said three beams comprising a base beam aligned with the tail, and two auxiliary beams positioned symmetrically above the base beam, each beam itself having an identical width along its entire length, said three beams being inwardly bowed to each other proximate in a medial region to form contact regions, said contact region of the beam being positioned near $1\sqrt{2}$ of an entire length of each beam from the second end, a formula provided therewith wherein W1 is a width of the auxiliary beam, W2 is a width of the base beam and $\Theta$ is defined between a first line perpendicular to the base beam and a second line perpendicular to the base beam and a second line perpendicular to the either auxiliary beam, and is within a range of 7.5 to 90 degrees.

8. The female contact as described in claim 7, wherein the retention section is a U-shaped form including a bight portion aligned with the tail and the base beam, and two vertical legs opposite extending therefrom, at least a barb positioned on the top of each vertical leg.

* * * * *